US010174554B2

(12) United States Patent
Kuhnl-Kinel et al.

(10) Patent No.: US 10,174,554 B2
(45) Date of Patent: Jan. 8, 2019

(54) GATE WITH COUNTERWEIGHT AND LOWERING EXCHANGEABLE SPAN

(71) Applicants: Jacek Kuhnl-Kinel, Konstancin-Jeziorna (PL); Piotr Wojciechowski, Budy-Grzybek (PL)

(72) Inventors: Jacek Kuhnl-Kinel, Konstancin-Jeziorna (PL); Piotr Wojciechowski, Budy-Grzybek (PL)

(73) Assignee: Jacek Kuhnl-Kinel, Warsaw (PL)

( * ) Notice: Subject to any disclaimer, the term of this patent is extended or adjusted under 35 U.S.C. 154(b) by 180 days.

(21) Appl. No.: 15/103,606

(22) PCT Filed: Dec. 30, 2014

(86) PCT No.: PCT/PL2014/000163
§ 371 (c)(1),
(2) Date: Jun. 10, 2016

(87) PCT Pub. No.: WO2015/102502
PCT Pub. Date: Jul. 9, 2015

(65) Prior Publication Data

US 2016/0312532 A1 Oct. 27, 2016

(30) Foreign Application Priority Data

Jan. 3, 2014 (PL) ..... 406783
Dec. 29, 2014 (PL) ..... 410784

(51) Int. Cl.
*E06B 11/00* (2006.01)
*E06B 11/02* (2006.01)
(Continued)

(52) U.S. Cl.
CPC ..... *E06B 11/022* (2013.01); *E05D 13/14* (2013.01); *E05D 15/165* (2013.01); *E05F 11/54* (2013.01);
(Continued)

(58) Field of Classification Search
CPC ..... E06B 11/025; E06B 11/022; E06B 11/04; E06B 11/02; E05F 15/673; E05F 15/665;
(Continued)

(56) References Cited

U.S. PATENT DOCUMENTS 4,322,913 A * 4/1982 Himmer ..... E06L 37/32 49/168
5,072,544 A * 12/1991 Breck, Jr. ..... E05F 15/665 119/484
(Continued)

FOREIGN PATENT DOCUMENTS

AT 008 630 U1 10/2006
CN 2567318 Y 8/2003
(Continued)

OTHER PUBLICATIONS

English_Abstract_of_AT8630U1.
(Continued)

*Primary Examiner* — Chi Q Nguyen
(74) *Attorney, Agent, or Firm* — Ladas & Parry LLP

(57) ABSTRACT

The gate has an exchangeable span that is fixed to the load bearing beam and is connected with pulley bearings and rope-slings to the system of adjustable counterweights. The drive system is fitted with an electric drive with a worm-wheel mounted to the load bearing beam that travels vertically along the worm. The beam, span and the drive travel on adjustable guiderails inside a reinforced concrete pit in the direction opposite to that of counterweights. The load bearing beam is fitted with rollers and retaining rollers mounted to the cover. Emergency (manual) operation of the gate is possible by turning a crank handle connected with the worm, having released the lock that prevents the worm from rotating on its axis.

13 Claims, 6 Drawing Sheets

(51) Int. Cl.

| | |
|---|---|
| ***E05F 15/673*** | (2015.01) |
| ***E05F 15/665*** | (2015.01) |
| ***E05D 13/00*** | (2006.01) |
| ***E05D 15/16*** | (2006.01) |
| ***E05F 11/54*** | (2006.01) |
| ***E06B 11/04*** | (2006.01) |

(52) U.S. Cl.
CPC ..... *E05F 15/665* (2015.01); *E05F 15/673* (2015.01); *E06B 11/025* (2013.01); *E06B 11/04* (2013.01); *E05Y 2201/416* (2013.01); *E05Y 2201/434* (2013.01); *E05Y 2201/50* (2013.01); *E05Y 2201/502* (2013.01); *E05Y 2900/40* (2013.01)

(58) Field of Classification Search
CPC ..... E05F 15/635; E05F 15/643; E05F 15/57; E05D 15/165; E05D 15/16; E05D 13/14; E05Y 2201/50; E05Y 2900/40; E05Y 2201/502; E05Y 2201/434; E05Y 2201/416; E01F 13/048
USPC ..... 49/33, 70, 69, 358, 504, 506, 337, 349, 49/352, 445
See application file for complete search history.

(56) References Cited

U.S. PATENT DOCUMENTS 5,177,900 A * 1/1993 Solowiej ..... A01K 1/035 49/25
6,560,926 B1 * 5/2003 Gillett ..... E06B 7/32 49/169
6,691,463 B1 * 2/2004 Richmond ..... A01K 1/0017 119/484
6,966,147 B2 * 11/2005 Solowiej ..... A01K 1/035 49/169
8,595,976 B1 * 12/2013 Solowiej ..... E06L 37/32 49/169
8,854,215 B1 * 10/2014 Ellis ..... E06L 37/32 340/573.1
2007/0234643 A1 * 10/2007 Siegal ..... E05D 13/1284 49/360

FOREIGN PATENT DOCUMENTS

| | | | |
|---|---|---|---|
| DE | 102008042979 | | 3/2009 |
| EP | 0 163 180 | A2 | 12/1985 |
| EP | 0 672 813 | A1 | 9/1995 |
| PL | P.390861 | | 10/2011 |
| PL | P.390861 | A | 10/2011 |
| PL | 215360 | B1 | 11/2013 |
| SU | 631638 | A | 11/1978 |
| WO | 2007/039713 | A2 | 4/2007 |

OTHER PUBLICATIONS

English_Abstract_of_DE102008042979A1.
SU631638_Espacement_Bibliographic_Data.
English_Abstract_of_CN2567318Y.
English_Abstract_of_EP0672813.
English_Abstract_of_EP0163180.
PL390861A1_Espacenet_Bibliograhic_Data.
PL215360B1_Espacenet_Bibliographic_Data.pdf.

* cited by examiner

GATE WITH COUNTERWEIGHT AND LOWERING EXCHANGEABLE SPAN

CROSS-REFERENCE TO RELATED APPLICATION

This U.S. application claims priority under 35 U.S.C. 371 to, and is a U.S. National Phase application of, the International Patent Application No PCT/PL2014/000163, filed 30 Dec. 2014 which claims priority from Polish Applications P.406783 filed 3 Jan. 2014 and P.410784 filed 29 Dec. 2014, the entire content of the above-mentioned patent application is incorporated by reference as part of the disclosure of this U.S. application.

FIELD OF THE INVENTION

The subject of the invention is a gate with counterweight and lowering exchangeable span driven by a worm drive system, that as a whole make up a gate.

BACKGROUND OF THE INVENTION

Gates are commonly found as either single or double swing or as sliding gates. Single or double swing gates have wings that rotate on hinges that are fixed to fence posts or other parts of fencing. Sliding gates slide along a track or are suspended along the length of the fence. Very rarely do you find gates that lower into a cavity. Such gates move vertically along guide posts that normally extend above ground level. All varieties of gates can be fitted with elements of automation that allow them to be remotely opened and closed. Some of the automation elements are an actuator that is a drive system for the gate and a remote control device that allows the actuators to be activated remotely. The automation elements are fitted with protection devices that safeguard people and property from being accidentally damaged by the operation of the gate drive system.

The inconvenience of swing and sliding gates is the necessity to have appropriately sufficient space in front of the gate or alongside the fence to open the gate, however gates that lower into a cavity do not require this space to operate.

Solutions that are known to technically allow span gates to lower into a cavity in the ground are used for gates that are quite low (up to 1.5 m) and are also not very wide. These type of gates require guide posts that protrude above ground level to a height that is at least the same as the height of the span. Additionally, due to limitations in the space dedicated for the fitment of the actuators that move the span, the actuators have a limited lifting force, and consequently it is not possible to lift spans that have a very large mass. It is not without significance that the majority of existing span gates which lower into a cavity in the ground require access shafts with a ladder to install and maintain the gates, making the emergency operation very difficult if not impossible without a heavy handling equipment. The solutions that have been used in the gates to date do not allow for the use of any type of span that is tailor made to the individual taste of the Customer, neither are they easy to be changed once installed. In the majority of cases, it becomes very complicated to change the existing type of gate (i.e. a swing or sliding gate) to a gate with a span that lowers into a cavity, when the same span is to be reused.

SUMMARY OF THE INVENTION

These inconveniences are not present in the invention "Gate with counterweight and lowering exchangeable span".

The unique solution is made up of: a reinforced concrete pit, where all of the mechanical elements of the gate are located, an exchangeable span, connected by a system of catches to a load bearing beam, a load bearing beam with mounting slots and catches to the exchangeable span, a set of silent self-adjusting rollers permanently connected to the load bearing beam, two separate guiderails, where sets of rollers connected to the load bearing beam move up, a counterweight with a infinitely adjustable weight, a safe worm drive system. All these elements make up the complete gate.

The reinforced concrete pit is a slot, where the span on the load bearing beam and the counterweights connected with the load bearing beam with a system of rope-slings move in opposite directions in the guiderails on sets of rollers.

Pulley bearings that hold counterweights hanging off a steel cable are mounted on a crosspiece at the top part of the pit. These crosspieces also serve as the pit geometry stabilizer and as a support for the pit closing covers. The brackets which fix the guiderails in place are mounted in the bottom and the top section of the pit. The guiderails have three-way adjustment. The gate unit is stabilized in the closed position by a set of moving rollers that are below ground level at all times. Additional stabilization is ensured by the set of retaining rollers mounted under the gate cover and which "clasp" around the span.

The counterweight is made up of concrete or steel weights that travel up and down in the pit as one combined set. The total weight of the counterweight equals the total weight of the load bearing beam, the span and the electric drive with a worm-wheel. This weight may be adjusted by adding or removing weights adequately to mass of the span.

The electric drive with a worm-wheel is permanently fixed to the load bearing beam and moves together with it when the span is lifted/lowered.

Vertical movement of the drive and the span is possible as the worm-wheel turns on the locked worm that is not able to rotate on its axis when the system operates in automatic mode.

In emergency mode (e.g. when there is a power outage or when rollers are blocked) the worm should be unlocked to allow its rotation on its axis. In this mode the worm-wheel is locked and vertical movement of the drive with the span is possible by turning a manual crank handle mounted in the worm socket.

An advantage is that the gate is stabilized in the closed position by adequately selected set of counterweights, stabilising rollers and the drive firmly connected with the vertically mounted worm. All these allow for the total elimination of any guides that protrude above ground level.

An advantage is that the gate can be fitted with a span of any weight as it is possible to precisely adjust the weight of the counterweight.

An advantage is that the load bearing beam and the system of catches and locks provides full flexibility for span configurations, heights and widths.

An advantage is that lifting and lowering of the gate is executed through electric drive system with worm-wheel and vertically mounted worm that allows for manual lowering and lifting of the gate when a lock is released.

An advantage is that the load bearing beam with exchangeable span is counterbalanced by counterweights in such a way so that the gate is neutrally balanced in any position.

An advantage is that the drive system allows for fast lowering and lifting of the span at 17-20 meters per minute, which combined with the fact that the gate opening way is twice as short as for standard sliding gate systems results in the total time of gate opening/closing reduced by several times. This makes also possible to use the gate for pedestrian access onto a property.

An advantage is that all of the key drive and control systems are located in a safe and dry zone of the reinforced concrete pit that ensures easy access for maintenance.

An advantage is that a sump pump for dirty water fitted with an automatic start and stop switch pumps out water directly from the bottom of the pit, where it collects.

An advantage is that the system of adjusted counterweights makes the gate have a small inertia that allows for the gate mechanism to be stopped quickly in the event that any unwanted obstacle is detected, thus ensuring a high level of safety.

An advantage is that the use of a set of pulley bearings with a plastic shield on the rings ensures silent movement of the beam and span along the length of the pit.

An advantage is that at the bottom of the pit, a safety end stop made of metal and rubber is installed. Due to the precise selection of the lengths of the cables that connect the counterweight to the beam, the beam stops at the minimum distance from the rubber end when in the lowered position. On the other hand, in the lifted position, the counterweight is at the minimum distance from the rubber end that makes the system safe.

An advantage is that the drive system is fitted with an integrated optical detection system, precise limit switches, circuit-breakers, warning lights and sirens, and radio-wave control.

BRIEF DESCRIPTION OF THE DRAWINGS

The invention will now be described solely by way of example and with reference to the accompanying drawings in which.

DETAILED DESCRIPTION

Figure 1:
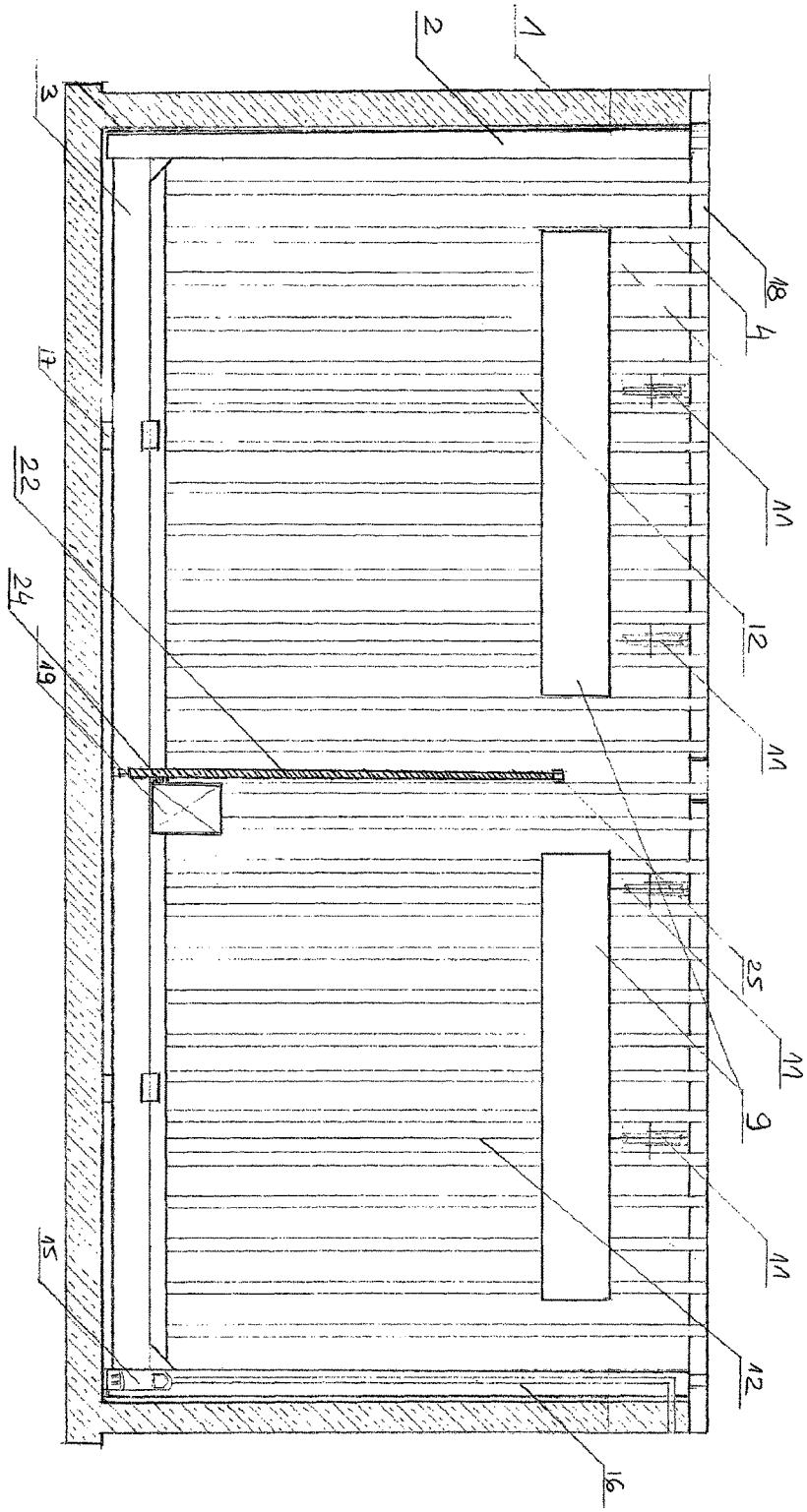
FIG. 1 is a longitudinal elevation of the gate.
Figure 2:
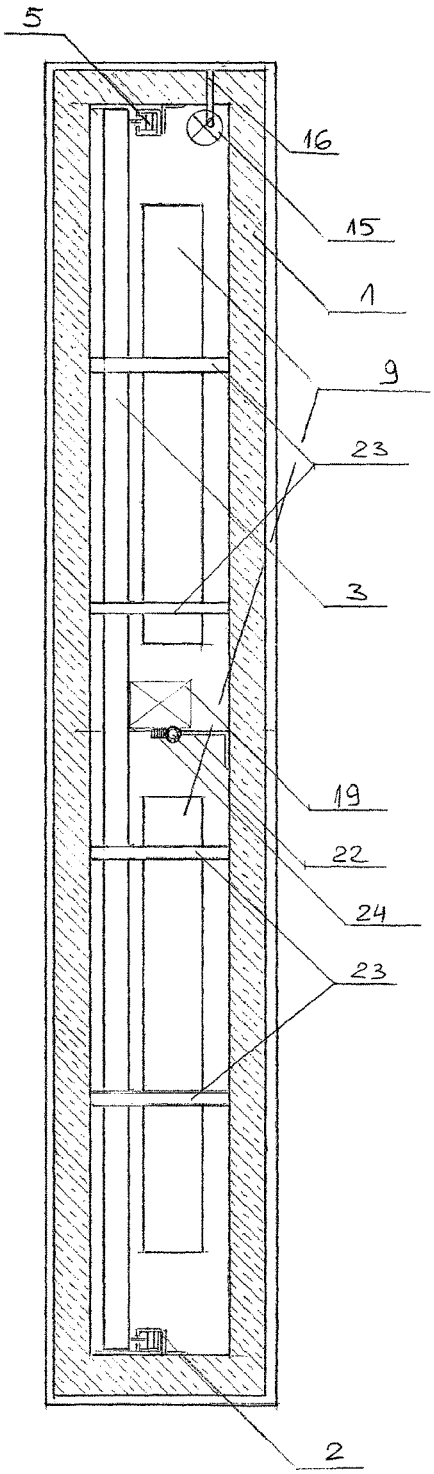
FIG. 2 is a plan view of the gate.
Figure 3:
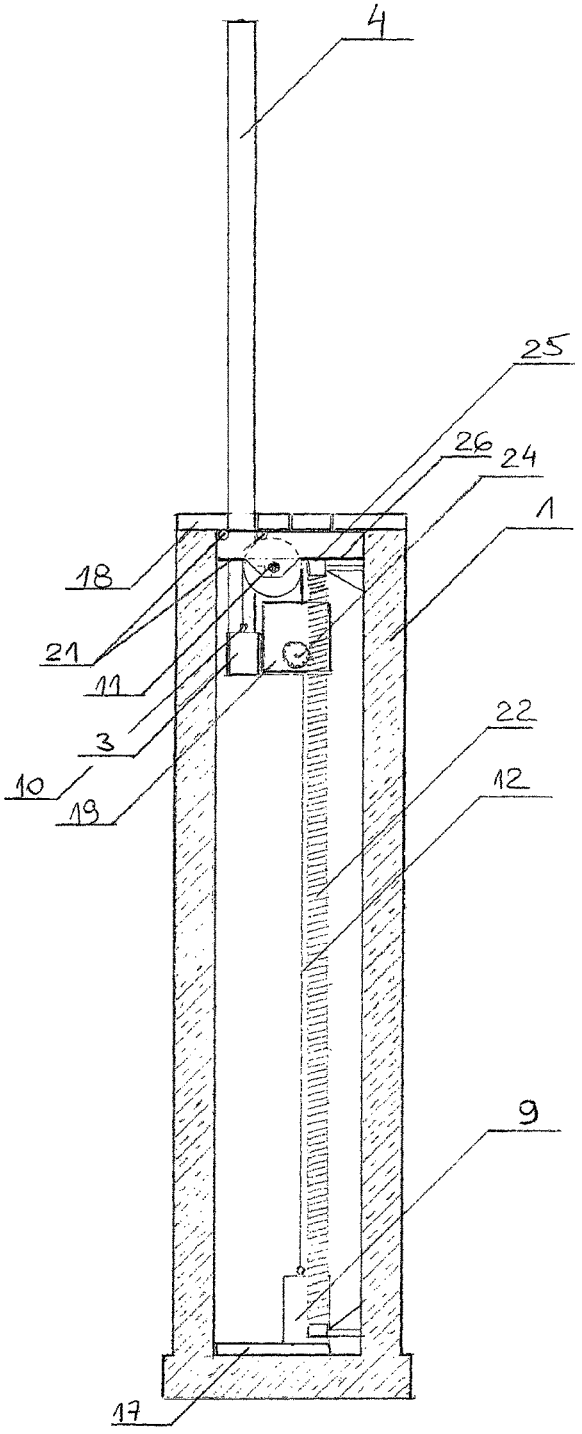
FIG. 3 is a side elevation of the gate, the load bearing beam in lifted position, typical span and the drive system shown.
Figure 4:
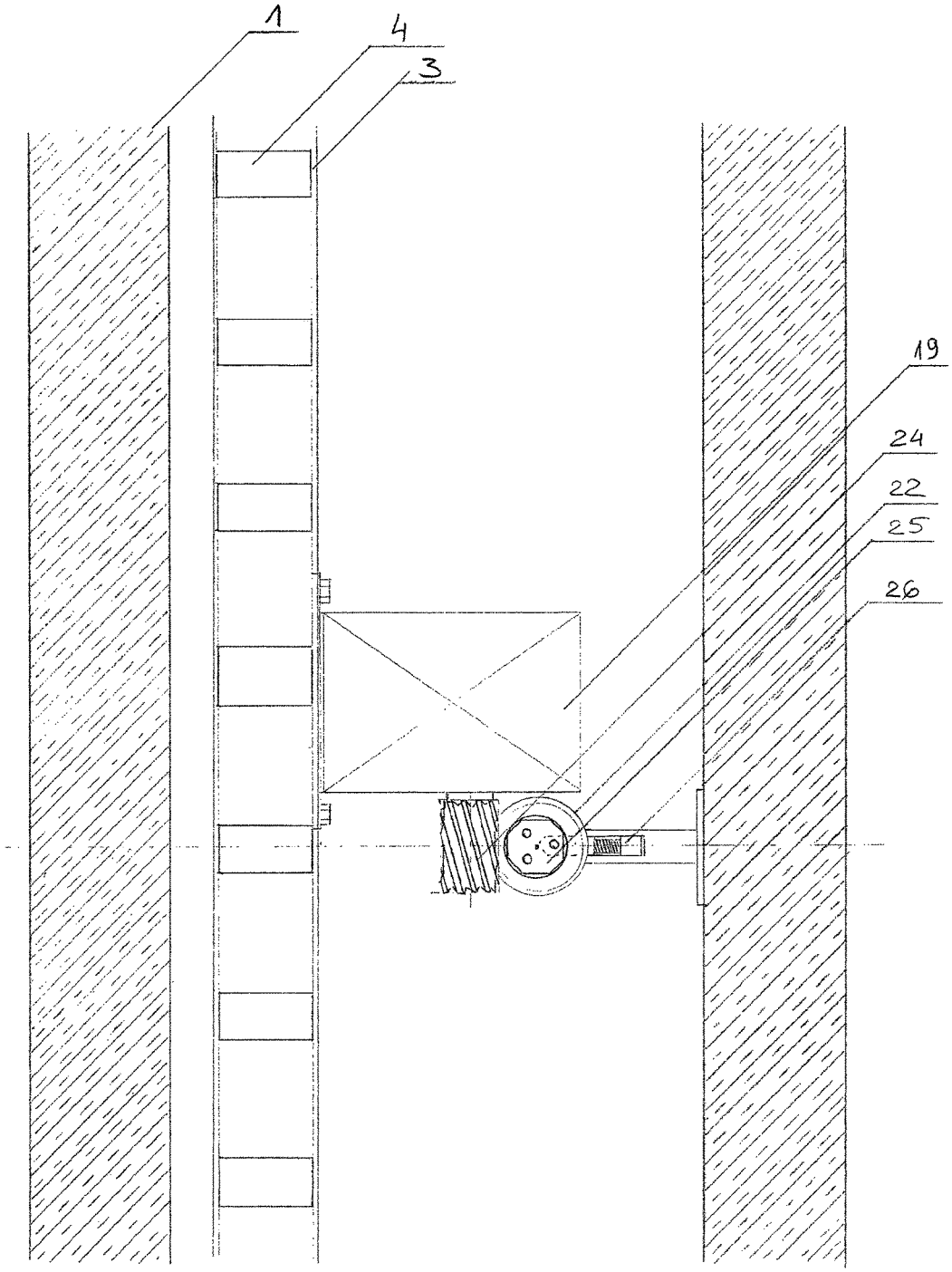
FIG. 4 is a part of the plan view of the gate, worm lock and crank handle socket shown.
Figure 5:
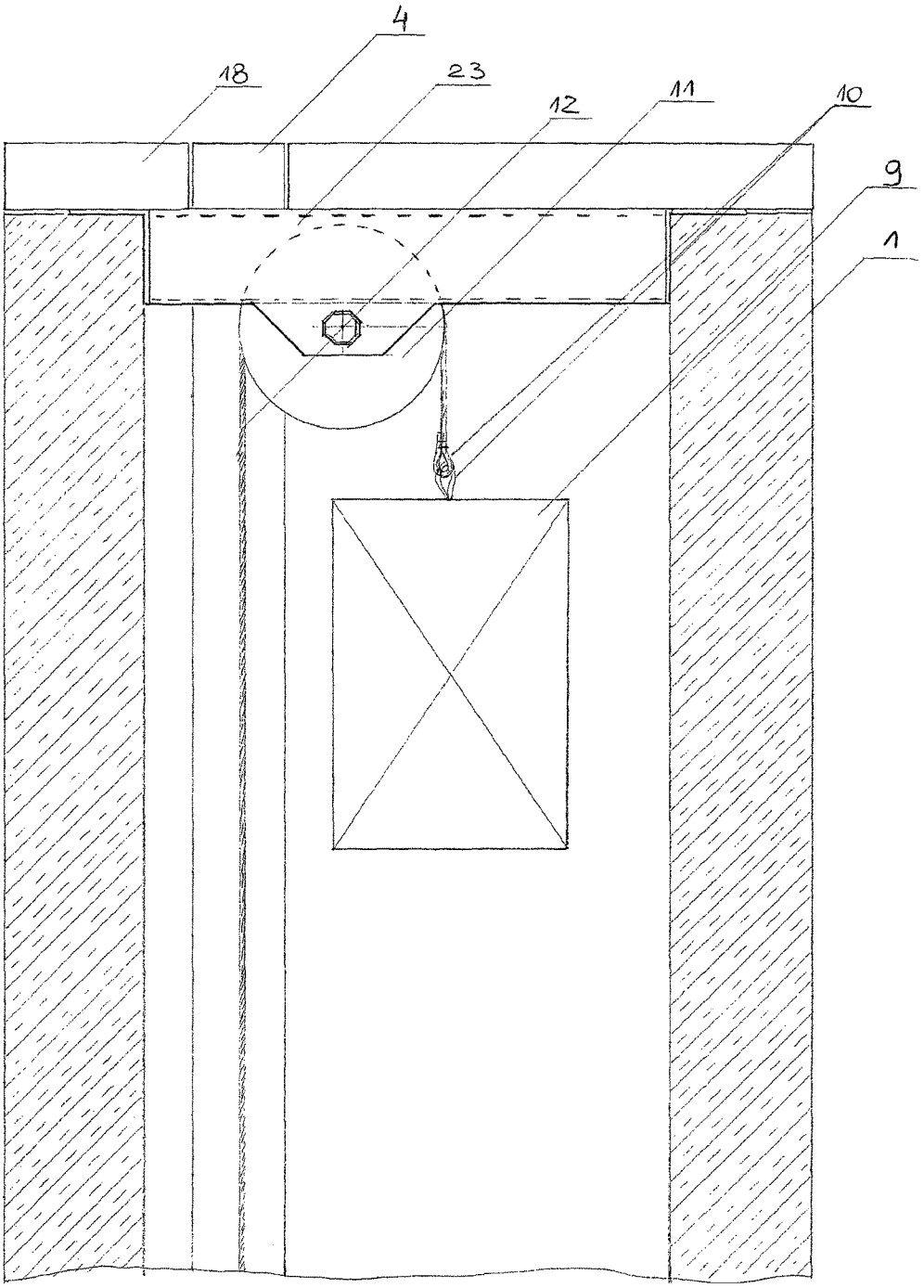
FIG. 5 is a part of the elevation of the gate span crosspiece, pulley bearing and counterweight.
Figure 6:
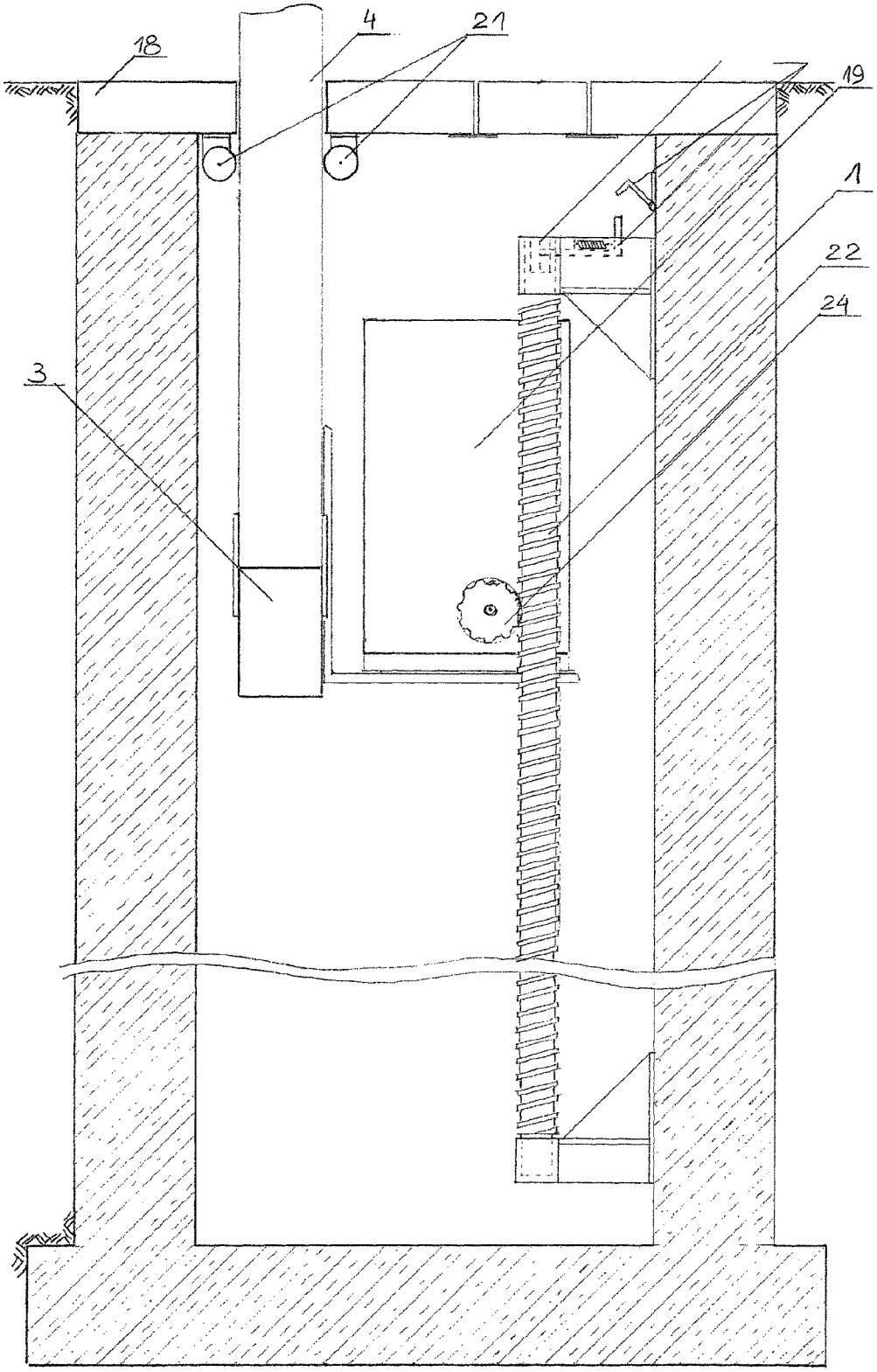
FIG. 6 is a part of the side elevation of the pit; the worm with lock and emergency mode operation socket, as well as retaining rollers shown.

The main assembly of the gate is a reinforced concrete pit 1. In the pit 1, the guiderail system 2 is mounted for the load bearing beam 3 with the span 4 to move along this. A span of any design is mounted and fixed mechanically or by welding to the universal load bearing beam 3. Soft and silent operation is ensured by the use of rollers 5 and retaining rollers 21.

Due to the use of a set of counterweights 9 with a weight that is adjustable by the addition or removal of weights, any span 4 and load bearing beam 3 may be stabilized in a neutrally balanced position. As a result it is possible to manually operate the system in any position of the gate.

The operation cycle of the gate is executed with the use of an electric drive 19 with a worm-wheel 24 that is mounted to the load bearing beam 3 with screws and connected to the worm 22. Rotation of the worm on its vertical axis is disabled with the lock 26. A manual mode is activated by placing a crank handle in the worm socket 25 and release of the lock 26 on the worm 22. This enables the worm to rotate on its vertical axis. The span may be lifted or lowered by turning a crank handle in the proper direction.

In order to reactivate the automatic mode, the worm must be locked and crank handle removed from the worm socket.

The set of counterweights 9 is fixed to the bottom of the load bearing beam with catches 10, rope-slings 12 and pulley bearings 11. Additionally, in the pit 1 a sump pump 15 is installed with a control system and pipework 16 to drain the water from the pit 1. At the bottom of the pit 1 a safety end stops 17 made of metal and rubber are installed to protect the load bearing beam 3 and the counterweight 9 in the case of uncontrolled drop. A system of covers 18 supported on crosspieces 23 ensures the safety of operation in the area where the pit 1 and the span 4 meet. These covers have holes that match the type of span that is used.

The drive system is fitted with a system of electrical connections that are not shown in the figures (to make them easier to read), audible signals and warning lights, and a control system with radio signal receivers and an optical detection system.

The described invention has a wide range of uses as a vehicle entrance/exit gate onto/from a property where due to space constraints or for more aesthetic reasons, the use of a traditional single swing, double swing or sliding gate is not recommended. Another place where the described gate can be installed is any industrial, military, healthcare establishment or ambulance depot whatsoever, where the nature of operations requires the minimum opening/closing time of the gate in either automatic or emergency mode. Fast and easy mode change from automatic to emergency mode, and vice versa, is not negligible here as this allows for manual operation of the gate from either side of it by physically weaker persons. This unique feature of the invention, namely the very short time required to fully open and close the gate, also allows for it to be used as a remotely controlled pedestrian access gate. Also relatively easy exchange of the span is not negligible here as this gate is useful for all types of fences exposed to frequent damage, or where the look and arrangement changes periodically (e.g. at themed exhibitions, fencing for fairs). As design of the spans may be chosen freely it provides a lot of room to manoeuvre for designers of modern, innovative, pioneering facilities. The above described invention will make it possible for them to further enhance their designs by the incorporation of, for example, "invisible" glass gates.

What is claimed is:

1. A gate comprising:

(a) a pair of vertical guiderails secured to opposed walls in a pit below a surface of the ground;

(b) a load bearing beam;

(c) a span secured to and projecting from the load bearing beam;

(d) rollers connected to the load bearing beam and disposed within the vertical guiderails for facilitating movement of the load bearing beam within the vertical guiderails from a first position with the span disposed below the surface of the ground to a second position with the span projecting above the surface of the ground;

(e) first means for counterbalancing a weight of the span and load bearing beam so that the load bearing beam and span can be stabilized within the vertical guiderails at the first position, the second position or a position in between.

2. The gate according to claim 1, comprising second means for electrically driving the load bearing beam and span from the first position to the second position such that the gate can be operated in either an electric mode or manually.

3. The gate according to claim 2, wherein the second means for electrically driving comprises a worm-wheel and a worm, the worm-wheel and worm being disposed below the ground.

4. The gate according to claim 3, comprising third means for covering an opening of the pit while permitting the span to project through the opening.

5. The gate according to claim 4, wherein the worm is mounted under the third means for covering.

6. The gate according to claim 5, comprising a lock for locking the gate in the electric mode.

7. The gate according to claim 5, wherein the worm comprises a socket for a crank handle.

8. The gate according to claim 1, wherein the first means for counterbalancing comprises a plurality of counterweights and a set of crosspieces with attached pulley bearings, and wherein rope-slings connect the plurality of counterweights with the load bearing beam.

9. The gate according to claim 8, wherein catches for fastening the rope-slings run through the pulley bearings.

10. The gate according to claim 1, wherein the load bearing beam has mounting slots into which screws are insertable to fix the span to the load bearing beam.

11. The gate according to claim 1, wherein a sump pump is disposed in a slot at the bottom of the pit.

12. The gate according to claim 1, wherein the vertical guiderails are fixed to the opposed walls with steel angle brackets, said angle brackets being adjustable in three dimensions.

13. The gate according to claim 1, wherein the walls are made of concrete.

* * * * *